United States Patent [19]

Kamath

[11] Patent Number: 4,459,473

[45] Date of Patent: Jul. 10, 1984

[54] SELF-REGULATING HEATERS

[75] Inventor: Hundi P. Kamath, Palo Alto, Calif.

[73] Assignee: Raychem Corporation, Menlo Park, Calif.

[21] Appl. No.: 380,400

[22] Filed: May 21, 1982

[51] Int. Cl.[3] ..... H05B 3/12; H05B 3/56

[52] U.S. Cl. ..... 219/553; 219/505; 219/528; 219/549; 338/22 R; 338/214

[58] Field of Search ..... 219/212, 504, 505, 510, 219/528, 535, 541, 548, 549, 544, 552, 553, 543; 338/22 R, 22 SD, 214; 29/611; 174/DIG. 8, 52 PE; 252/511

[56] References Cited

U.S. PATENT DOCUMENTS

| | | | |
|---|---|---|---|
| 2,575,987 | 11/1951 | York et al. | 219/528 |
| 2,719,907 | 10/1955 | Combs | 219/528 |
| 3,441,893 | 4/1969 | Gordon et al. | 338/214 X |
| 3,757,086 | 9/1973 | Indoe | 219/528 |
| 3,781,528 | 12/1973 | Damron | 219/549 X |
| 3,861,029 | 1/1975 | Smith-Johannsen et al. | 29/611 |
| 4,017,715 | 4/1977 | Whitney et al. | 219/553 |
| 4,072,848 | 2/1978 | Johnson et al. | 219/528 |
| 4,100,673 | 7/1978 | Leavines | 29/611 |
| 4,117,312 | 9/1978 | Johnson et al. | 219/548 |
| 4,250,400 | 2/1981 | Lee | 219/549 |
| 4,271,350 | 6/1981 | Crowley | 219/212 |
| 4,276,466 | 6/1981 | Middleman et al. | 219/523 |
| 4,309,597 | 1/1982 | Crowley | 219/549 |
| 4,330,703 | 5/1982 | Horsma | 219/553 |

FOREIGN PATENT DOCUMENTS

| | | | |
|---|---|---|---|
| 001511 | 4/1979 | European Pat. Off. . | |
| 2614433 | 10/1976 | Fed. Rep. of Germany . | |
| 2634999 | 2/1977 | Fed. Rep. of Germany . | |
| 116448 | 10/1946 | Sweden | 338/214 |
| 468704 | 3/1969 | Switzerland . | |
| 1167551 | 10/1969 | United Kingdom . | |
| 1168162 | 10/1969 | United Kingdom . | |
| 1540482 | 2/1979 | United Kingdom . | |
| 2110910 | 6/1983 | United Kingdom . | |

OTHER PUBLICATIONS

European Search Report.

*Primary Examiner*—Volodymyr Y. Mayewsky
*Attorney, Agent, or Firm*—Timothy H. P. Richardson

[57] ABSTRACT

Self-regulating electrical strip heaters which comprise at least two elongate conductors and at least one elongate resistive heating strip which contacts the conductors alternately as it progresses down the length of the heater. The conductors can be separated from each other by an insulating strip, with the heating strip being wrapped around the conductors and the insulating strip. Alternatively the conductors can be wrapped around a core comprising the heating strip and an insulating strip. The self-regulating characteistic of the heater preferably results from use of a PTC material, particularly a PTC conductive polymer in the heating strip. Preferably the junctions between the conductors and the heating strip are coated with a low resistivity conductive polymer composition.

36 Claims, 22 Drawing Figures

SELF-REGULATING HEATERS

FIELD OF THE INVENTION

This invention relates to self-regulating electrical strip heaters.

INTRODUCTION TO THE INVENTION

Many elongate electrical heaters, e.g. for heating pipes, tanks and other apparatus in the chemical process industry, comprise two (or more) relatively low resistance conductors which are connected to the power source and run the length of the heater, with a plurality of heating elements connected in parallel with each other between the conductors (also referred to in the art as electrodes). In conventional conductive polymer strip heaters, the heating elements are in the form of a continuous strip of conductive polymer in which the conductors are embedded. In other conventional heaters, known as zone heaters, the heating elements are one or more resistive metallic heating wires. In zone heaters, the heating wires are wrapped around the conductors, which are insulated except at spaced-apart points where they are connected to the heating wires. The heating wires contact the conductors alternately and make multiple wraps around the conductors between the connection points. For many uses, elongate heaters are preferably self-regulating. This is achieved, in conventional conductive polymer heaters, by using a continuous strip of conductive polymer which exhibits PTC behavior. It has also been proposed to make zone heaters self-regulating by connecting the heating wire(s) to one or both of the conductors through a connecting element composed of a ceramic PTC material.

Elongate heaters of various kinds, and conductive polymers for use in such heaters, are disclosed in U.S. Pat. Nos. 2,952,761, 2,978,665, 3,243,753, 3,351,882, 3,571,777, 3,757,086, 3,793,716, 3,823,217, 3,858,144, 3,861,029, 4,017,715, 4,072,848, 4,085,286, 4,117,312, 4,177,376, 4,177,446, 4,188,276, 4,237,441, 4,242,573, 4,246,468, 4,250,400, 4,255,698, 4,271,350, 4,272,471, 4,309,596 and 4,309,597, 4,314,230, 4,315,237 and 4,318,881, J. Applied Polymer Science 19, 813–815 (1975), Klason and Kubat; Polymer Engineering and Science 18, 649–653 (1978), Narkis et al; and commonly assigned U.S. Ser. Nos. 601,424 (Moyer), now abandoned, published as German OLS No. 2,634,999; 750,149 (Kamath et al), now abandoned, published as German OLS No. 2,755,077; 732,792 (Van Konynenburg et al), now abandoned, published as German OLS No. 2,746,602; 751,095 (Toy et al), now abandoned, published as German OLS No. 2,755,076; 798,154 (Horsma et al), now abandoned, published as German OLS No. 2,821,799; 141,984 (Gotcher et al), 141,987 (Middleman et al) now U.S. Pat. No. 4,413,301, 141,988 (Fouts et al), 141,989 (Evans), 141,991 (Fouts et al), 150,909, 150,910 (Sopory), now U.S. Pat. No. 250,491 (Jacobs et al), 254,352 (Taylor) and the application filed Apr. 16, 1982, by Midgley et al (MP0812) Ser. No. 369,309. The disclosure of each of the patents, publications and applications referred to above is incorporated herein by reference.

SUMMARY OF THE INVENTION

This invention relates to improved self-regulating strip heaters which comprise (1) first and second elongate, spaced-apart, conductors which can be connected to a source of electrical power and (2) an elongate resistive heating strip which is in electrical contact alternately with the first conductor and the second conductor at contact points which are longitudinally spaced-apart along the length of the strip and along the length of each of the conductors.

In one embodiment of the invention, the heating strip comprises an elongate conductive polymer component. Such heaters are distinguished from conventional conductive polymer strip heaters and conductive polymer heaters as disclosed in U.S. Pat. Nos. 4,271,350 and 4,309,597 by the requirement that the contact points are longitudinally spaced apart along the length of the heating strip. This is a difference which can result in very important advantages. One advantage results from the fact that elongate conductive polymer components are generally produced by methods which involve continuously shaping the conductive polymer composition into a strip, eg. by melt-extrusion or by deposition onto a substrate. It has been found that the uniformity of the resistance of such a strip is greater in the longitudinal (or "machine") direction (eg. the direction of extrusion) than in the transverse direction. In the known conductive polymer heaters, current passes through the conductive polymer mainly or exclusively in the transverse direction, whereas in the strip heaters of the invention, the current usually passes through the conductive polymer mainly or exclusively in the longitudinal direction. In consequence the new heaters can have improved power output and voltage stability. Another advantage is that if an arcing fault occurs in a known conductive polymer heater, the fault can be propagated along the whole length of the heater, and thus render the whole heater inoperative. On the other hand, if such a fault occurs in a heater of the invention, it is difficult or impossible for it to propagate along the heater, because there is no continuous interface between the conductive polymer component of the heating strip and the conductors.

In a second embodiment of the invention, the self-regulating characteristic of the heater results from the use of a heating strip which exhibits PTC behavior. In this specification, a component is said to exhibit PTC behavior if its resistance increases by a factor of at least about 2 over a temperature range of 100° C. A more rapid increase in resistance is preferred, for example an increase in resistance by a factor of at least 2.5 over a temperature range of 14° C. or by a factor of at least 10 over a temperature range of 100° C., and preferably both. Such heaters are distinguished from known conductive polymer heaters by the requirement for spaced-apart contact points on the strip, as just described, and from self-regulating zone heaters as disclosed in U.S. Pat. No. 4,117,312 by the fact that the heating strip itself exhibits PTC behavior, whereas in U.S. Pat. No. 4,117,312 it is only the connecting element which exhibits PTC behavior. This difference results in important advantages, because the use of a small PTC connecting element as described in U.S. Pat. No. 4,117,312 results in very high power densities in the connecting element, with consequent danger of damage to the element or its connections to the bus wire and the heating wire.

In a third embodiment of the invention, the heating strip (a) has a resistance at 23° C. of at least 10, preferably at least 100, ohms per cm length and a cross-sectional area of at least 0.0001 $cm^2$, preferably at least 0.001 $cm^2$, and (b) makes electrical contact with each conductor each time the heating strip crosses the conductor. Such heaters are distinguished from known conductive polymer heaters by the requirement for spaced-apart contact points on the strip, as just described, and from self-regulating zone heaters as disclosed in U.S. Pat. No. 4,117,312 by the resistance and cross-sectional area requirements and the requirement for electrical contact at each crossing point. In this way I avoid a great disadvantage of known zone heaters, which is that multiple wraps of the heating wire are needed between contact points in order to obtain the necessary level of resistance, with the consequent need to insulate the bus wires except at the contact points.

The three embodiments of the invention are not, of course, mutually exclusive. Thus a preferred class of heaters of the invention comprises a PTC conductive polymer heating strip wrapped around a pair of conductors and making contact with each of the conductors at each wrapping point, the heating strip having for example a cross-sectional area of 0.002 to 0.08 $cm^2$ and a resistance of 100 to 5,000 ohms per cm length. Another class of heaters of the invention comprises two or three conductors wrapped around a central element which comprises an elongate PTC conductive polymer heating strip and an elongate insulating element, the conductors making contact with the PTC element at each wrapping point, the heating strip having for example a cross-sectional area of 0.002 to 0.6 $cm^2$ and a resistivity at 23° C. of 100 to 5,000 ohm.cm.

BRIEF DESCRIPTION OF THE DRAWING

The invention is illustrated in the accompanying drawings in which.

DETAILED DESCRIPTION OF THE INVENTION

Figure 1:
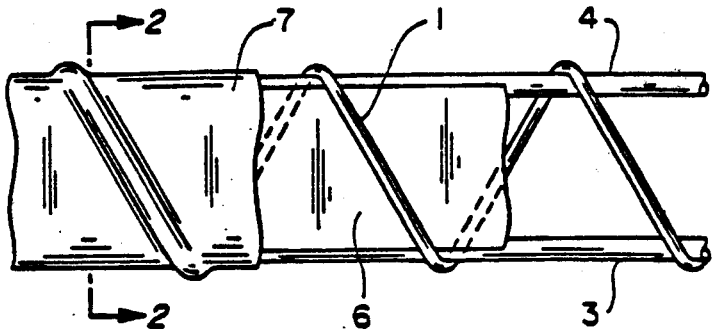
FIG. 1 is a plan view of a heater of the invention.
Figure 2:
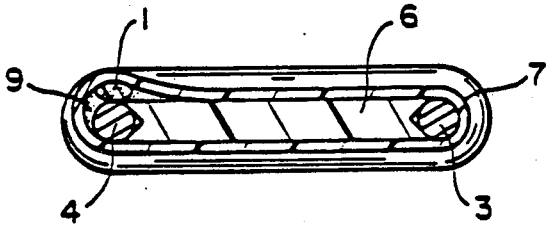
FIG. 2 is a cross-section along line 2—2 of FIG. 1.
Figure 3:
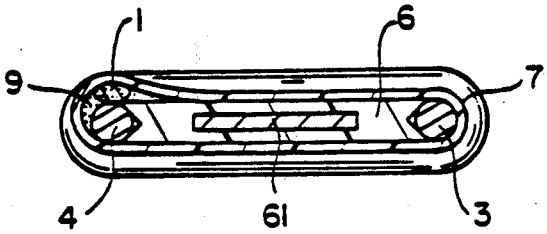
FIGS. 3 and 4 are cross-sections through heaters of the invention which are similar to the heater shown in FIG. 1 but which have different types of insulating strip separating the conductors.

The self-regulating character of the heater preferably results from the use of a heating strip which exhibits PTC behavior, particularly a heating strip comprising a component which runs the length of the heating strip and which exhibits PTC behavior when its resistance/-temperature characteristic is measured in the absence of the other components of the heater, for example a heating strip comprising a PTC conductive polymer component. However, the heating strip can also exhibit PTC behavior as a result (at least in part) of constructing and arranging the heater so that, when the heater increases in temperature, the heating strip undergoes a reversible physical change (e.g. stretching due to thermal expansion of part of the heating strip and/or other components of the heater) which increases its resistance. When (as is usually the case) the heater comprises an insulating polymeric jacket, pressure exerted by this jacket can (but usually does not) influence the PTC behavior of the strip.

There are a wide variety of relative configurations of the heating strip(s) and the conductors which will give rise to the desired spaced-apart contact points. Generally it will be convenient for the conductors to be straight and the heating strip(s) to follow a regular sinuous path, or vice-versa. The path may be for example generally helical (including generally circular and flattened circular helical), sinusoidal or Z-shaped. However, it is also possible for both the conductors and the heating strip(s) to follow regular sinuous paths which are different in shape or pitch or of opposite hand, or for one or both to follow an irregular sinuous path. In one preferred configuration, the heating strip is wrapped around a pair of straight parallel conductors, which may be maintained the desired distance apart by means of a separator strip. In another configuration the heating strip is wrapped around a separator strip and the wrapped strip is then contacted by straight conductors. In another preferred configuration, the conductors are wrapped around one or more straight heating strips and one or more straight insulating cores; the core may be (or contain) the substrate to be heated, eg. an insulated metal pipe or a pipe composed of insulating material. In another configuration, the conductors are wrapped around an insulating core and are then contacted by straight heating strips. It is often convenient for the wrapped element to have a generally helical configuration, such as may be obtained using conventional wire-wrapping apparatus. However, other wrapped configurations are also possible and can be advantageous in ensuring that substantially all the current passing through the heating strip does so along the axis of the strip; for example when the conductors are wrapped around the heating strip(s), they can be wrapped so that their axes, as they cross the heating strip(s), are substantially at right angles to the axis of the heating strip, with the progression of the conductors down the length of the strip being mainly or exclusively achieved while the conductors are not in contact with the heating strip. In the various wrapped configurations, the wrapped component can for example follow a path which is generally circular, oval or rectangular with rounded corners. For the best heat transfer to a substrate, it is often preferred that the heater has a shape which is generally rectangular with rounded corners.

It is also possible for the heating strip to be laid out, eg. through use of a vibrating extrusion head, in a regular sinuous pattern, either on top of the conductors or on a support, with the conductors then being applied to the laid-out heating strip. If the heating strip is laid out on top of the conductors, further conductors can be placed on top of the original ones, thus sandwiching the heating strip in the middle of a two part conductor.

The novel heaters generally contain two elongate conductors which are alternately contacted by the heating strip. However, there can be three or more conductors which are sequentially contacted by the heating strip, provided that the conductors are suitably connected to one or more suitable power sources. When three or more conductors are present, they can be arranged so that different power outputs can be obtained by connecting different pairs of conductors to a single phase or two phase power source. When three conductors are present they can be arranged so that the heater is suitable for connection to a three phase power source. The conductors are usually parallel to each other. The conductors are preferably of metal, eg. single or stranded wires, but other materials of low resistivity can be used. The shape of the conductor at the contact points with the heating strip can influence the electrical characteristics of the junctions. Round wire conductors are often convenient and give good results, but conductors of other cross-sections (for example flat metal strips) can also be used. The conductors can be contacted by the heating strip directly or through an intermediate conductive component; for example the conductors can be coated with a layer of conductive material, eg. a low resistivity ZTC conductive polymer composition, before being contacted by the heating strip.

The conductors must remain spaced apart from each other, and for this reason the novel heaters preferably comprise at least one separator strip which lies between the conductors. The separator strip is preferably one which will remain substantially unchanged during preparation and use of the heater, except for thermal expansion and contraction due to temperature changes; such thermal expansion and contraction can be significant in influencing PTC behavior, especially when the separator strip comprises a metal insert, particularly when the insert is a conductor which generates heat by $I^2R$ heating during use of the heater, as further described below. The separator strip will usually have the same general configuration as the conductors, eg. if they are straight, the separator is straight, and if they are wrapped, the separator is wrapped with them.

In one class of heaters, the separator strip electrically insulates the conductors from each other so that, when the conductors are connected to a power source, all the current passing between the conductors passes through the heating strip or strips. Such a separator strip can consist essentially of insulating material. However, the properties of the heaters are improved if the separator has good thermal conductivity, and for this reason (since most materials of good thermal conductivity are also electrical conductors) the separator strip can comprise electrically conductive material, eg. metal, surrounded by insulating material; the conductive material can for example be one or more electrical conductors which run the length of the strip and which can be used to connect the heater in the way disclosed in the application filed Apr. 16, 1982, by Midgley et al. (MP0812), U.S. Ser. No. 369,309, and optionally to provide an auxiliary source of heat.

In another class of heaters, the separator strip is composed of electrically resistive material and thus provides an additional source of heat when the conductors are connected to a power source. In this class of heaters, the heater preferably comprises a second resistive heating strip which is composed of a conductive polymer composition and which is in continuous electrical contact with the conductors. The resistance and resistance/temperature characteristics of such a separator strip can be correlated with those of the heating strip or strips to produce desired results, as further discussed below. In such heaters there will usually be a continuous interface between the conductors and the conductive separator strip and at least a substantial proportion of the current which passes through the separator strip will do so in a transverse direction.

The conductors can also be maintained in desired positions by means of insulating material which also provides an insulating jacket around the conductors and heating strip or strips. The jacket can for example be in the form of a tube which has been drawn down around a pair of conductors having a heater strip wrapped around them.

In addition to the conductors which are contacted by the heating strip, the novel heaters can contain one or more additional elongate conductors which are insulated from the other electrical components and which can be used to connect the heater in the novel way disclosed in the application filed Apr. 16, 1982 by Midgley et al (MP0812), U.S. Ser. No. 369,309 and optionally to provide an auxiliary source of heat. As indicated above one or more of such conductors can be embedded in an insulating separator strip.

The novel heaters contain at least one heating strip which contacts the elongate conductors. In many cases, use of a single heating strip gives excellent results. However, two or more heating strips can be used, in which case the heating strips are usually, but not necessarily, parallel to each other along the length of the heater; the heating strips are preferably the same, but can be different. For a particular heating strip, heaters of the same power output can be obtained by a single strip wrapped at a relatively low pitch (a high number of turns per unit length) or by a plurality of parallel heating strips wrapped at a relatively high pitch; use of a plurality of strips results in a lower voltage stress on the heating strip.

The strip or strips are arranged so that successive contact points on each conductor are spaced apart from each other. If desired, one or more insulating members can be wrapped with one or more heating strips so as to maintain desired spacing between adjacent wraps of the heating strip or strips.

The heating strip can have any configuration which results in the desired alternate contact of the heating strip with the conductors. However, bending of the heater strip often has an adverse effect on its electrical and/or physical properties. Consequently it is preferred that the heating strip is in a configuration such that most, and preferably substantially all, of the parts of the heating strip which are electrically active (i.e. which make a useful contribution to the heat output of the heater) are not excessively bent, eg. have a radius of curvature at all points in the substantial current path which is at least 3 times, preferably at least 5 times, especially at least 10 times its diameter.

The heating strip preferably comprises a conductive polymer component which runs the length of the heating strip, and the invention will be chiefly described by reference to such a strip. However, it is to be understood that the invention includes any kind of resistive heating strip, for example a heating strip which comprises conductive ceramic material, e.g. desposited on single filament or multifilament yarn.

The heating strip can consist essentially of a single conductive composition, or it can comprise (a) a first component which runs the length of the heating strip and (b) a second component which runs the length of the heating strip and which is composed of a conductive composition, at least a part of the second component lying between the first component and the conductors. The first component can be electrically conducting, eg. be composed of a conductive polymer composition, or electrically insulating, eg. be composed of glass or other ceramic material or natural or synthetic polymeric material. The first and second components are preferably distinct from each other, eg. a first component which provides the core and a second component in the form of a jacket which surrounds the core. However, the second component can also be distributed in a first component which is preferably an electrical insulator, eg. a glass filament yarn which has been passed through a liquid conductive composition eg. a solvent-based composition. When the first and second components are both composed of a conductive polymer composition, the first component is preferably composed of a conductive polymer composition which exhibits PTC behavior with a switching temperature below the switching temperature of the second component.

An alternative way of providing the desired PTC behavior (or of modifying PTC behavior resulting from use of a PTC heating strip) is to construct the heater so that when the heater increases in temperature, the length of the conductive polymer component of the heating strip is caused to change by an amount different from its normal thermal expansion or contraction. For example the heater can contain conductors or a separator strip comprising a material having a high coefficient of thermal expansion, or the heating strip can comprise a first component composed of a material having a high coefficient of thermal expansion. In this way, for example, a heating strip comprising a ZTC conductive polymer component can be caused to exhibit PTC behavior. This is useful because it makes it possible to use ZTC conductive polymer compositions if this is desirable, eg. for particular physical properties. It is of course important that any stretching of the heating strip should be below its elastic limit, and for this reason the heating strip may comprise a first component which is composed of an elastomeric material.

As briefly noted above, the novel heaters can contain a separator strip which provides a second resistive heating strip, which is composed of a second conductive polymer composition and which is in continuous electrical contact with the conductors. The second conductive polymer composition can exhibit PTC behavior, with a switching temperature which is above or below the switching temperature, $T_s$, of a PTC conductive polymer in the wrapped heating strip. Alternatively the second conductive polymer composition can exhibit ZTC behavior at temperatures below $T_s$ and can provide a current path between the conductors whose resistance (a) is higher than the resistance of the current path along the first heating strip when the heater is at 23° C. and (b) is lower than the resistance of the current path along the first heating strip at an elevated temperature.

The production of conductive polymer heating strips for use in the present invention can be effected in any convenient way, eg. by melt-extrusion, which is usually preferred, or by passing a substrate through a liquid (eg. solvent-based) conductive polymer composition, followed by cooling or solvent-removal. When producing the strip by melt-extrusion, the draw-down ratio has an important effect on the electrical properties of the heater. Thus use of higher draw-down ratios generally increases the resistance uniformity of the strip but reduces the extent of any PTC effect. The optimum draw-down ratio depends on the particular conductive polymer composition.

The thickness of the conductive polymer in the heating strip is preferably 0.010 to 0.1 inch, eg. 0.025 to 0.056 inch. The strip can be of round or other cross-section; for example the heater strip can be in the form of a flat tape.

The conductive polymer heating strips can optionally be cross-linked, eg. by irradiation, either before or after they are assembled into heaters.

A very wide variety of conductive polymers can be used in the heating strips, for example compositions based on polyolefins, copolymers of olefins and polar comonomers, fluoropolymers and elastomers, as well as mixtures of two or more of these. Suitable conductive polymers are disclosed in the publications referenced above. The resistivity of such conductive polymers at 23° C. is usually 1–100,000, preferably 100 to 5,000, particularly 200 to 3,000, ohm.cm.

The novel heaters are preferably made by wrapping the heating strip (or strips) around the conductors, or vice versa, while maintaining the conductors the desired distance apart, either through use of a separator strip or otherwise. When using a PTC heating strip, care should be taken to make use of a wrapping tension which provides a suitable compromise between the desire to bring the heating strip into good contact with the conductors and the desire to avoid stretching the strip, which usually causes undesirable changes in its resistance and/or resistance/temperature characteristics. It is preferred to coat the junctions between the conductors and the heating strip with a low resistivity (preferably less than 1 ohm.cm) composition, e.g. a conductive polymer composition (eg. a solvent-based composition which is allowed to dry after it has been applied), so as to reduce contact resistance. Such a coating can also help to ensure that substantially all the current passes only through the substantially straight portions of the heating strip. Care should be taken, however, to ensure that the coating does not extend any substantial distance up the heating strip beyond the junctions, since this reduces the effective (heat-generating) length of the heating strip. Similar low resistance coatings can be applied to the contact points by other methods, eg. by flame-spraying or vapor deposition of a metal.

Other methods which can be used to reduce contact resistance include pre-heating the conductors before they are contacted by the heating strip, and heat-treating conductive polymer adjacent the conductors after the heater has been assembled, The whole heater can be heated or localized heating can be effected eg. by powering the conductors.

A particular advantage of the present invention is that heaters having different electrical characteristics can be easily produced from a single heating strip. For example, a range of very different heaters, eg. of different power outputs, can easily be produced merely by changing the pitch used to wrap the heating strip or the conductors, and/or by using two or more heating strips, and/or by changing the distance between the conductors. These different variables can be maintained substantially constant or one or more of them can be varied periodically to produce a heater having segments of different power outputs. Further, if desired, the pitch of the wrapped component and/or the distance between the conductors can be varied gradually to compensate for changes in the potential difference between the conductors at different distances from the power source.

In assembling the novel heaters, the presence of voids is preferably avoided, and a polysiloxane grease or other thermal conductor can be used to fill any voids.

Referring now to the drawing, the reference numerals in the figures denote the same or similar components. Thus numerals, 1, 2, 1A and 2A denote heating strips; 11 denotes a first conductive polymer component of a heating strip; 12 denotes a second conductive polymer component of a heating strip; 13 denotes an insulating component of a heating strip; 14 denotes a multifilament yarn composed of an insulating material; 3, 4, 5 and 5A denote round wire conductors; 6 denotes a separator strip which maintains the conductors in a desired configuration; and 61 denotes a metal conductor embedded in an insulating separator strip; 7 denotes an outer insulating jacket; and 9 denotes a low resistivity conductive material at the junctions of the heating strip and the conductors.

Figure 4:
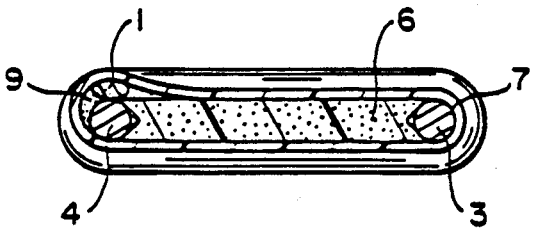
Figure 5:
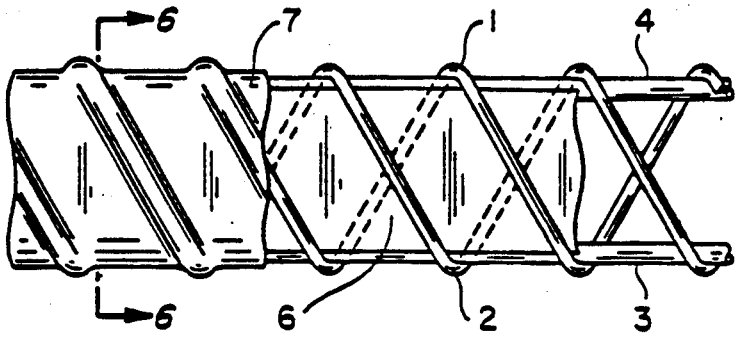
FIG. 5 is a plan view of another heater of the invention.
Figure 6:
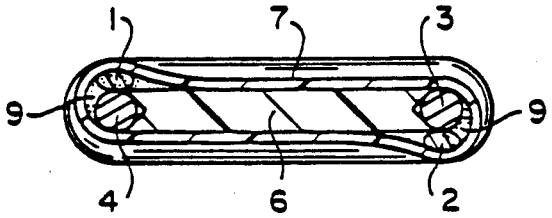
FIG. 6 is a cross-section along line 6—6 of FIG. 5.
Figure 7:
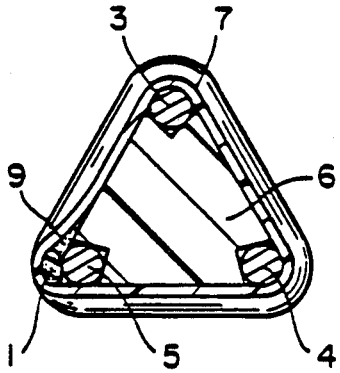
FIGS. 7, 8 wnd 9 are cross-sections through other heaters of the invention.
Figure 8:
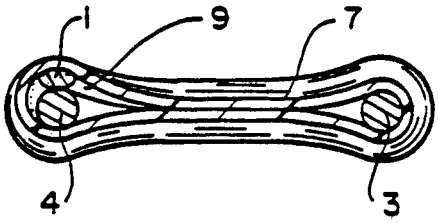
Figure 9:
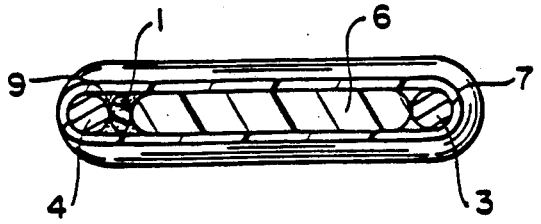
Figure 10:
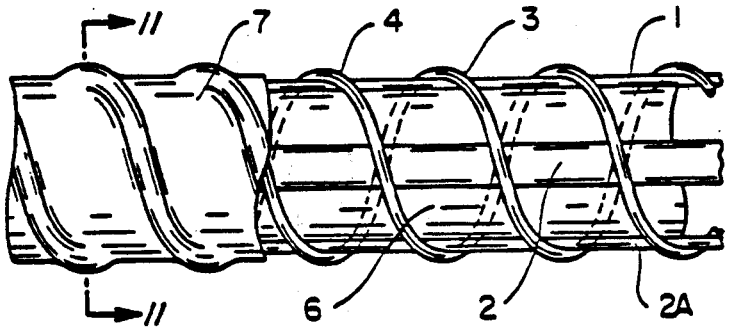
FIG. 10 is a plan view of another heater of the invention.
Figure 11:
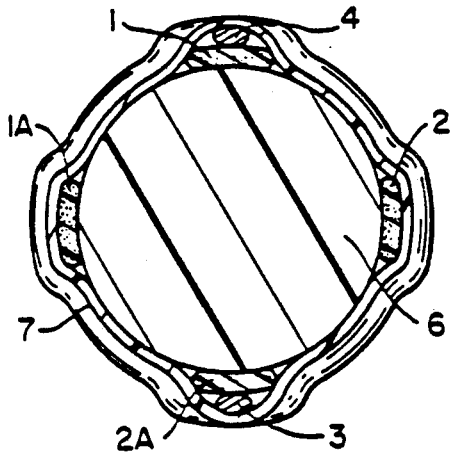
FIG. 11 is a cross-section along line 11—11 of FIG. 10.

Referring now to FIGS. 1–4, a single heating strip 1 is wrapped helically around conductors 3 and 4 and separator strip 6. Electrical contact between the heating strip and the conductors is enhanced by means of low resistivity material 9 which forms a fillet between the strip and the conductor at the contact points. The separator strip may consist of polymeric insulating material (FIG. 2), or comprise a metal conductor embedded in polymeric insulating material (FIG. 3), or consist of a conductive polymer composition (FIG. 4). FIGS. 5 and 6 are very similar to FIGS. 1 and 2 except that there are two heating strips 1 and 2. FIG. 7 shows a heater which is suitable for use with a 3-phase power source and which comprises three conductors 3, 4 and 5 separated by a generally triangular insulating strip 6 and having a heating strip 1 wrapped around them. In each of FIGS. 1–7 there is a polymeric insulating jacket 7 which surrounds the heating strip, the conductors and the separator. FIG. 8 is the same as FIG. 1 except that it does not contain a separator strip, the insulating jacket 7 serving to maintain the conductors in the desired configuration. FIG. 9 is similar to FIG. 1 except that the heater strip is wrapped around the separator and the conductors are then brought into contact with the heating strip. FIGS. 10 and 11 show a heater in which heating strips 1, 2, 1A and 2A are spaced around an insulating separator strip 6 and conductors 3 and 4 are wrapped helically around the separator strip and the heating strips.

Figure 12:
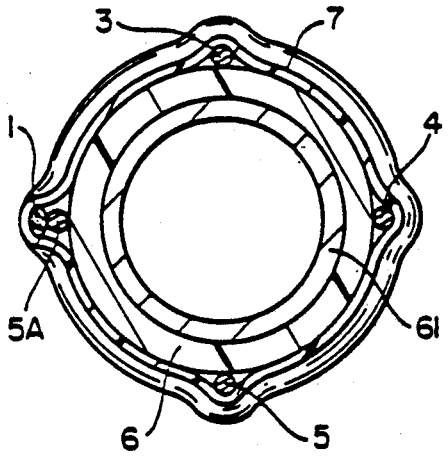
FIG. 12 is a cross-section through a heater of the invention including a pipe.
Figure 13:
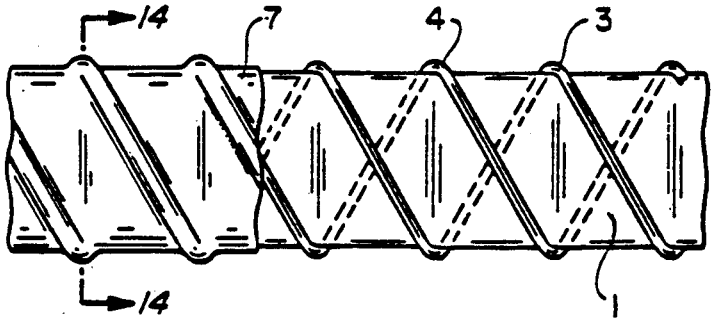
FIG. 13 is a plan view of another heater of the invention.
Figure 14:
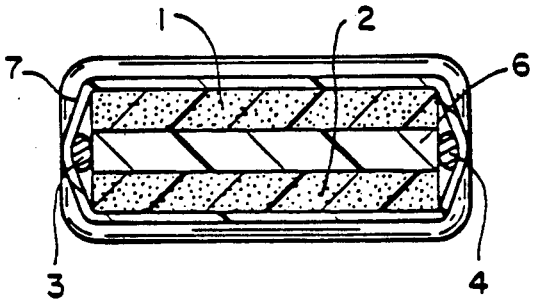
FIG. 14 is a cross-section along line 14—14 of FIG. 13.
Figure 15:
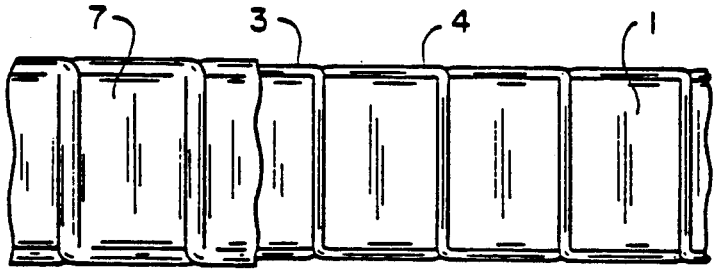
FIGS. 15 and 16 are plan and side views of another heater of the invention.
Figure 16:
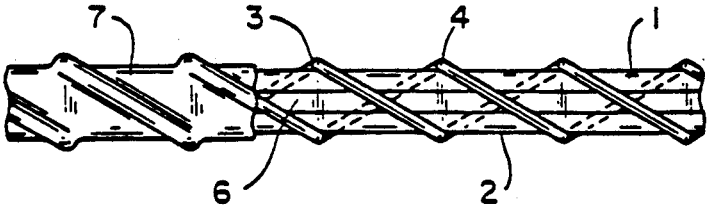
Figure 17:
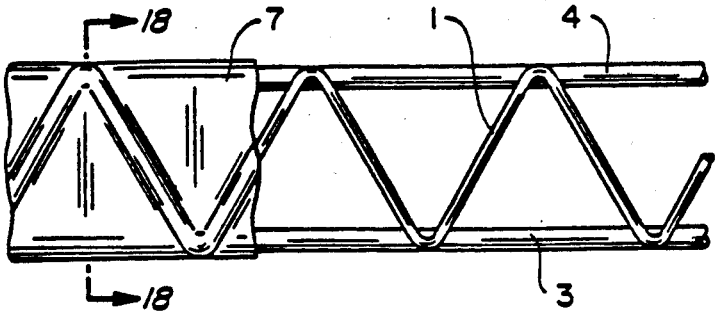
FIG. 17 is a plan view of another heater of the invention.
Figure 18:
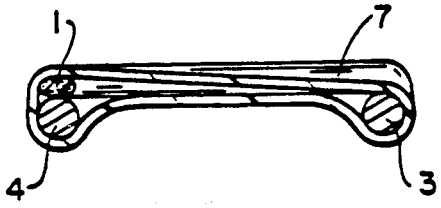
FIG. 18 is a cross-section along line 18—18 of FIG. 17.

FIG. 12 shows a heater in which a heating strip 1 is wrapped helically around four conductors 3, 4, 5 and 5A which are supported by a metal pipe 61 which is surrounded by insulating material 6. FIGS. 13 and 14 show a heater in which conductors 3 and 4 are wrapped helically around a core comprising an insulating strip 6 sandwiched between heating strips 1 and 2. FIGS. 15 and 16 show a heater which is the same as that shown in FIGS. 13 and 14 except that the conductors are wrapped in a Z-configuration so that they cross the heating strips 1 and 2 at right angles. FIGS. 17 and 18 show a heater in which a heating strip 1 is laid down in a sinusoidal path on top of conductors 3 and 4.

Figure 19:
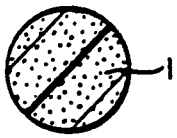
FIGS. 19, 20, 21 and 22 are cross-sections through resistive heating strips suitable for use in heaters of the invention.
Figure 20:
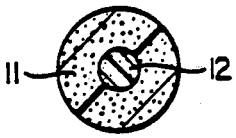
Figure 21:
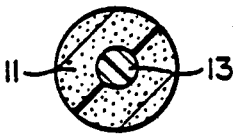
Figure 22:
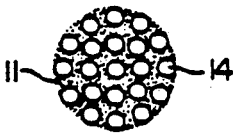

FIGS. 19, 20, 21 and 22 show cross-sections of different heating strips which can be used in the invention. FIG. 19 shows a strip which is a simple melt-extrudate of a PTC conductive polymer. FIG. 20 shows a strip which contains a melt-extruded core 12 of a ZIC conductive polymer and a melt-extruded outer layer 11 of a PTC conductive polymer. FIG. 21 shows a strip which contains an insulating core 13 and a melt-extruded outer layer 11 of a PTC conductive polymer. FIG. 22 shows a multifilament glass yarn which has been coated, at least on its surface, with a conductive polymer composition, eg. by passing the yarn through a water- or solvent-based composition followed by drying.

The invention is illustrated in the following Examples. The various ingredients used in the Examples are further identified below. The ethylene/tetrafluoroethylene copolymer was Tefzel 2010 available from du Pont. The tetrafluoroethylene/perfluoroalkoxy copolymer was Teflon PFA available from du Pont. The tetrafluoroethylene/hexafluoropropylene copolymer was Teflon FEP 100 available from du Pont. The zinc oxide was Kadox 515 available from Gulf and Western. Continex N330 is a carbon black available from Continental. Vulcan XC-72 is a carbon black available from Cabot. The graphite emulsion was Electrodag 502, available from Acheson Colloids.

EXAMPLE 1

Preparation of the Heating Strip

The ingredients listed in Table 1 below were dry-blended in a Henschel mixer before being introduced into a Werner-Pfleiderer 53 mm ZSK co-rotating twin screw extruder heated to 280° C. After chopping the extrudate into pellets and drying them 16 hours at 150° C. the pellets were fed into a 0.75 inch (1.91 cm) Brabender extruder heated to 288° C. (550° F.) and fitted with an 0.040 inch (0.10 cm) diameter die. The strip was drawn to give a strip with a diameter of 0.020 inch (0.05 cm).

TABLE 1

| | Wt % |
|---|---|
| Ethylene/tetrafluoroethylene copolymer | 66.6 |
| Continex N330 | 13.0 |
| ZnO | 20.0 |
| Process aid | 0.4 |

Preparation of the Conductors

18 AWG nickel-coated copper wire was drawn through a graphite emulsion and dried in a Lindberg furnace.

Assembly of the Heater

Using a metal guide to maintain two conductors 0.25 inch (0.63 cm.) apart, the heating strip was wrapped around the conductors at a 0.5 inch (1.27 cm) pitch using a USM T-97 machine. The wrapped conductors were taken off the metal guide and immediately jacketed with a 0.020 inch (0.05 cm) thick layer of high density polyethylene, using a 1.5 inch (3.8 cm) Davis-Standard extruder heated to 163° C.

EXAMPLE 2

Preparation of the Heating Strip

The ingredients listed in Table 2 were fed into a Werner-Pfleiderer 53 mm ZSK co-rotating twin screw extruder heated to 355° C. and fitted with a pelletizing die. After passing through a water trough, the extrudate was chopped into pellets and dried at 150° C. for 16 hours. These pellets were fed into a 0.75 inch (1.91 cm) single screw Brabender extruder heated to 340° C. and fitted with a 0.070 inch (0.18 cm) die. The resulting strip was drawn down to give a strip with a 0.044 inch diameter (0.11 cm).

TABLE 2

| | Wt % |
|---|---|
| Tetrafluoroethylene/perfluoroalkoxy copolymer | 88.2 |
| Vulcan XC-72 | 11.8 |

Preparation of the Spacer

Pellets of tetrafluoroethylene/perfluoroalkoxy copolymer filled with 20% glass fibers were dried at 150° C. for 16 hours and fed into a 1.5 inch (3.8 cm) Davis-Standard extruder heated to 405° C. The plastic was fed through a concave-sided, flat-top die to give a 0.20 by 0.23 inch (0.51×0.58 cm) separator strip having concave ends.

Assembly of the Heater

Two 6 AWG nickel-coated copper wires were placed in the concave ends of the separator strip and the heating strip was wrapped around the conductors and separator strip at a 0.125 inch (0.32 cm) pitch using a USM T97 machine. The conductors and the heating strip in the areas where it contacted the conductors were coated with a graphite emulsion. The resulting heater was jacketed in turn with a 0.024 inch (0.06 cm) thick layer of tetrafluoroethylene/perfluoroalkoxy copolymer containing 5% glass fibers, using a 1.5 inch (3.8 cm) Davis-Standard extruder, a 12 end/34 AWG Sn/Cu braid, and a second jacket of 0.035 inch (0.09 cm) thick ethylene-polytetrafluoroethylene copolymer. The jacketed heater was heat-treated for 15 hours at 450° F. (232° C.), and then allowed to cool.

EXAMPLE 3

Preparation of the Heating Strip

The ingredients listed in Table 3 were extruded as described in Example 2 through a 0.052 inch (0.13 cm) die and drawn to give a fiber 0.046 inch (0.12 cm) in diameter.

TABLE 3

| | Wt %. |
|---|---|
| Tetrafluoroethylene/perfluoroalkoxy copolymer | 87.0 |
| Vulcan XC-72 | 13.0 |

Preparation of the Separator Strip

Pellets of tetrafluoroethylene/perfluoroalkoxy copolymer filled with 20% glass fibers were dried as in Example 2 and extruded through a 0.30×0.075 inch (0.76×0.19 cm) die, around a 0.225×0.016 inch (0.57×0.04 cm) strip of aluminum alloy.

Assembly of the Heater

The procedure described in Example 2 was followed using 14 AWG Ni/Cu conductors. The resulting heater had a resistance of 300–450 ohm/ft and a power output at 120 v of about 25 watts/ft.

EXAMPLE 4

Preparation of the Heating Strip

The procedure described in Example 3 was followed utilizing the ingredients listed in Table 4. The fiber was extruded through a 0.070 inch (0.18 cm) die and drawn to give a 0.044 inch (0.011 cm) strip.

TABLE 4

| | Wt % |
|---|---|
| Tetrafluoroethylene/perfluoroalkoxy copolymer | 88.5 |
| Vulcan XC-72 | 11.5 |

Preparation of the Separator Strip

Pellets of tetrafluoroethylene/perfluoroalkoxy copolymer filled with 20% glass fibers were dried as in Example 2 and extruded through a 0.42×0.075 inch (1.07×0.19 cm) die, around an aluminum strip 0.340×0.160 inch (0.86×0.04 cm).

Assembly of the heater

The procedure described in Example 2 was followed using 14 AWG Ni/Cu conductors. The resulting heater had a power output of about 25 watts/ft at 277 V.

EXAMPLE 5

A heating strip was produced as described in Example 2. A length of the heating strip was helically wrapped with a 0.5 inch (1.27 cm) pitch around two 16 AWG Ni/Cu conductors separated by a separator strip as described in Example 3. A second length of heating strip was similarly wrapped by hand with the same pitch mid-way between the wraps of the first length of heating strip. The interface of the conductors and the heating strips was coated with a graphite emulsion as in Example 2.

EXAMPLE 6

Preparation of the Heater Strip

The ingredients listed as Formulation A in Table 5 were blended in a Henschel mixer to form a masterbatch. This formulation was then introduced into a 53 mm Werner Pfleiderer ZSK co-rotating twin screw extruder with 88% by weight of tetrafluoroethylene/-hexafluoropropylene copolymer and mixed at 320° C. to give a mixture containing the ingredients shown under Final Mix in Table 5. The composition was extruded through a pelletizing die, cooled in a water trough, and chopped into pellets. After drying the pellets at 150° C. for 16 hours, they were fed into a 0.75 inch (1.91 cm) Brabender extruder heated to 345° C. and fitted with a crosshead containing an 0.08 inch (0.20 cm) die. A layer approximately 0.015 inch (0.038 cm) thick of the conductive material was extruded onto a 0.017 inch diameter (0.042 cm) stranded glass fiber. This glass fiber had been previously coated with a 0.002 inch (0.005 cm) thick layer of a graphite emulsion and dried.

TABLE 4

| | Formulation A | Final Mix |
|---|---|---|
| ZnO | 25.0 | 3.00 |
| Vulcan XC-72 | 74.5 | 8.94 |
| Processing aid | 0.5 | 0.06 |
| Tetrafluoroethylene/hexafluoropropylene copolymer) | | 88.00 |

EXAMPLE 7

Preparation of the Heating Strip

Pellets prepared as in Example 6 was used for this strip. Using a 0.75 inch (1.91 cm) Brabender extruder heated to 345° C., and fitted with a cross-head, a layer approximately 0.015 inch (0.038 cm) thick of the conductive material was extruded onto a stranded glass fiber with a diameter of 0.025 inch (0.063 cm). The fiber was quenched in a water trough and spooled.

Preparation of the Separator Strip

Using a tetrafluoroethylene/hexafluoropropylene copolymer in a 1.5 inch (3.8 cm) Davis-Standard extruder, at 345° C., a separator strip containing an aluminum strip was prepared as described in Example 3. The final dimensions of the concave-sided, flat-topped spacer were 0.300×0.055 inch (0.76×1.40 cm).

Pre-coating of the Conductors

The ingredients listed in Table 6 were melt-blended and pelletized as described in Example 6. The dried pellets were then fed into an extruder fitted with a cross-head die and coated onto 22 AWG nickel-coated wire as a layer 0.014 inch (0.034 cm) thick.

Assembly of the Heater

Using a USM T-97 wrapping machine, the heating strip was wrapped at a 0.025 inch (0.63 cm) pitch around the separator strip and two pre-coated conductors in the concave ends of the separator strip. The interface of the conductors and the heating strip was coated with a graphite emulsion as in Example 2. The heater was then jacketed with a layer 0.025 inch (0.63 cm) thick of a tetrafluoroethylene/perfluoropropylene copolymer containing 10% of glass fibers.

TABLE 5

| | |
|---|---|
| Tetrafluoroethylene/perfluoroalkoxy copolymer | 88 |
| Zinc oxide | 3 |
| Vulcan XC 72 | 8.94 |
| Process Aid | 0.06 |

I claim:

1. A self-regulating strip heater which comprises (1) first and second elongate, spaced-apart, conductors which can be connected to a source of electrical power and (2) an elongate resistive heating strip which (i) comprises an elongate PTC component which (a) runs the length of the heating strip and (b) is composed of a conductive polymer composition which exhibits PTC behavior, and (ii) is in electrical contact alternately with the first conductor and the second conductor at contact points which are longitudinally spaced apart along the length of the strip and along the length of each of the conductors.

2. A heater according to claim 1 which further comprises a strip of insulating material which lies between the conductors so that, when the conductors are connected to a power source, all the current passing between the conductors passes through the heating strip.

3. A heater according to claim 2 wherein the heating strip is wrapped around the insulating strip and the conductors.

4. A heater according to claim 3 wherein the insulating strip comprises at least one metal conductor surrounded by insulating material.

5. A heater according to claim 3 wherein the insulating strip comprises a pipe.

6. A heater according to claim 2 wherein the insulating material is in the form of an insulating jacket which surrounds the heating strip and the conductors.

7. A heater according to claim 1 wherein the heating strip consists essentially of a melt-extruded conductive polymer composition which exhibits PTC behavior and which has a resistivity at 23° C. of 100 to 5000 ohm.cm.

8. A heater according to claim 1 wherein the heating strip comprises (a) a first component which runs the length of the heating strip and (b) a second component which runs the length of the heating strip and is composed of a conductive polymer composition, at least a part of said second component lying between the first component and the conductors.

9. A heater according to claim 8 wherein the first component is composed of an insulating material.

10. A heater according to claim 8 wherein the first component is composed of a conductive material.

11. A heater according to claim 10 wherein the second component is composed of a conductive polymer composition which exhibits PTC behavior with a switching temperature $T_{s2}$ and the first component is composed of a conductive polymer composition which exhibits PTC behavior with a switching temperature below $T_{s2}$.

12. A heater according to claim 1 which further comprises a second resistive heating strip which is composed of a conductive polymer composition and which is in continuous electrical contact with the conductors.

13. A heater according to claim 12 wherein the first heating strip is composed of a first conductive polymer composition which exhibits PTC behavior with a switching temperature Ts and the second heating strip is composed of a second conductive polymer composition which exhibits PTC behavior with a switching temperature substantially different from Ts.

14. A heater according to claim 12 wherein the first heating strip is composed of a first conductive polymer composition which exhibits PTC behavior with a switching temperature Ts and the second heating strip (i) is composed of a conductive polymer composition exhibiting ZTC behavior at temperatures below Ts and (ii) provides a current path between the conductors whose resistance (a) is higher than the resistance of the current path along the first heating strip when the heater is at 23° C. and (b) is lower than the resistance of the current path along the first heating strip at an elevated temperature.

15. A heater according to claim 1 wherein there is a coating of a ZTC conductive polymer composition over the junctions between the conductors and the heating strip.

16. A heater according to claim 15 wherein said coating has a resistivity of less than 1 ohm.cm.

17. A heater according to claim 1 wherein the heating strip comprises a conductive polymer component which has been shaped by melt extrusion along the axis of the strip.

18. A heater according to claim 1 wherein the conductors are wrapped around the heating strip and an insulating strip.

19. A heater according to claim 1 wherein the heating strip has substantially the same cross-section throughout its length.

20. A heater according to claim 1 wherein the heating strip has a resistance at 23° C. of at least 10 ohms. per cm length and a cross-sectional area of at least 0.0001 $cm^2$.

21. A heater according to claim 20 wherein the heating strip has a cross-sectional area of 0.002 to 0.08 $cm^2$ and a resistance of 100 to 5,000 ohms per cm length.

22. A heater according to claim 1 wherein the heating strip comprises carbon black dispersed in a crystalline polymer and increases in resistance by a factor of at least 2.5 over a temperature range of 14° C.

23. A heater according to claim 1 wherein the heating strip comprises carbon black dispersed in a crystalline polymer and increases in resistance by a factor of at least 10 over a temperature range of 100° C.

24. A heater according to claim 1 which comprises a plurality of heating strips which are wrapped around the conductors.

25. A self-regulating strip heater which comprises (1) first and second elongate, spaced-apart, conductors which can be connected to a source of electrical power and (2) an elongate resistive heating strip which (i) comprises an elongate PTC component which (a) runs the length of the heating strip and (b) is composed of a conductive polyer composition which has been shaped by melt-extrusion along the axis of the strip and which exhibits PTC behavior, and (ii) is wrapped around the conductors so that it is in electrical contact alternately with the first conductor and the second conductor at contact points which are longitudinally spaced apart along the length of the strip and along the length of each of the conductors.

26. A heater according to claim 25 wherein the conductors are parallel to each other and the heating strip follows a generally helical path around the conductors.

27. A heater according to claim 26 which further comprises a strip of insulating material which lies between the conductors so that, when the conductors are connected to a power source, all the current passing between the conductors passes through the heating strip.

28. A heater according to claim 25 wherein the conductors are round wires and there is a coating of a ZTC conductive polymer composition over the junctions between the heating strip and the conductors.

29. A heater according to claim 25 wherein the heating strip consists essentially of said conductive polymer composition.

30. A heater according to claim 29 wherein the heating strip increases in resistance by a factor of at least 10 over a temperature range of 100° C.

31. A heater according to claim 30 wherein the heating strip has a cross-section area of 0.002 to 0.08 $cm^2$ and a resistance of 100 to 5,000 ohm per cm length.

32. A heater according to claim 26 which comprises at least two substantially identical heating strips which are wrapped parallel to each other.

33. A self-regulating strip heater which comprises (1) first and second elongate, spaced-apart, parallel conductors which can be connected to a source of electrical power, (2) at least two substantially identical elongate resistive heating strips, each of which (i) consists essentially of a conductive polymer composition which has been shaped by melt-extrusion along the axis of the strip, which has a resistivity at 23° C. of 1 to 100,000 ohm.cm, and which exhibits PTC behavior such that the heating strip increases in resistance by a factor of at least 10 over a temperature range of 100° C., (ii) is wrapped in a helical path around the conductors so that it is in electrical contact alternately with the first conductor and the second conductor at contact points which are longitudinally spaced apart along the length of the strip and along the length of each of the conductors, and (3) a strip of insulating material which lies between the conductors so that, when the conductors are connected to a power source, all the current passing between the conductors passes through the heating strips.

34. A heater according to claim 33 wherein each of the heating strips has a cross-sectional area of 0.002 to 0.08 $cm^2$ and a resistance of 100 to 5,000 ohms per cm length, and wherein the conductive polymer composition comprises carbon black dispersed in a crystalline polymer.

35. A heater according to claim 33 wherein the conductors round wires.

36. A heater according to claim 33 wherein there is a coating of a ZTC conductive polymer composition over the junctions between the heating strip and the conductors.

* * * * *